United States Patent [19]

Claesson et al.

[11] 4,112,724

[45] Sep. 12, 1978

[54] TRANSPORTATION UNITS FOR SUPPORTING AND MOVING PLATE-FORMED ATTACHMENT MEMBER INTO AND OUT OF A PRESS STAND OF HYDRAULIC PRESS

[75] Inventors: Harry Claesson; Keijo Hellgren, both of Västerås, Sweden

[73] Assignee: ASEA Aktiebolag, Vasteras, Sweden

[21] Appl. No.: 804,838

[22] Filed: Jun. 8, 1977

[30] Foreign Application Priority Data

Jun. 9, 1976 [SE] Sweden ..... 7606461

[51] Int. Cl.[2] ..... B21D 22/10

[52] U.S. Cl. ..... 72/63; 72/420; 105/157 R

[58] Field of Search ..... 72/361, 63, 420; 105/157 R, 80, 176

[56] References Cited

U.S. PATENT DOCUMENTS

| | | | |
|---|---|---|---|
| 2,005,562 | 6/1955 | Ruth | 105/176 |
| 3,334,504 | 8/1967 | Moller | 72/63 |
| 3,545,241 | 12/1970 | Grankowski et al. | 72/63 |

*Primary Examiner*—Leon Gilden

*Attorney, Agent, or Firm*—Watson, Cole, Grindle & Watson

[57] ABSTRACT

Each of the ends of an elongated plate-formed attachment member, to which is attached a diaphragm and a press pad, is connected to a transportation unit which allow for the plate-formed attachment member to be moved into and out of a press stand along suitably provided tracks. The transportation units include bogies and connection units mounted on the bogies which support the plate-formed attachment member. The connection units include bearings so that the plate-formed attachment member can be rotated when positioned outside of the press stand, and at least one of the connection units include lifting cylinders to raise and lower the plate-formed attachment member as appropriate.

7 Claims, 3 Drawing Figures

TRANSPORTATION UNITS FOR SUPPORTING AND MOVING PLATE-FORMED ATTACHMENT MEMBER INTO AND OUT OF A PRESS STAND OF HYDRAULIC PRESS

BACKGROUND OF THE INVENTION

1. Field of the Invention

The present invention relates to hydraulic presses, and more specifically to structural systems allowing for the removal and replacement of diaphragms connected to a plate-formed attachment member operable within a press stand.

2. Description of the Prior Art

Presses are knwon, e.g., as set forth in U.S. Pat. No. 3,938,361, within a press stand includes a pressure space formed by an upper yoke, a lower yoke and spacers therebetween (which elements are held together by means of a prestressed strip sheath) and houses a pressure cell which includes a diaphragm of flexible material and a forming pad which is influenced by the diaphragm. The forming pad is also of flexible material and is capable of pressing a sheet of metal against a tool in order to be formed thereby, the sheet of metal taking on the shape of the tool, and the tool being positioned within the pressure space beneath the flexible pad.

Presses of the aforementioned type are often very large, such that the length of the working chamber within the press stand may be 5 meters and the width may be 2 meters. The diaphragm, forming pad and plate-formed attachment member(s) to which they are attached may be extremely heavy, and many problems are encountered when it is desired to remove and replace the diaphragm. According to the prior art, in order to replace the diaphragm the entire press stand, which may weigh several hundred tons, is rotated in its entirety so that the diaphragm, together with the plate-formed attachment member, can be detached and withdrawn. However, constructing the press stand so as to be rotatable involves various problems and undesirable constructional complications due to the enormous weight thereof.

Thus, it is an object of the present invention to design a support system for a plate-formed attachment member such that it can be easily inserted into and withdrawn from a press stand, the support system providing easy access to the diaphragm attached to the plate-formed attachment member and also allowing for the press stand to be constructed so as to be supported in a fixed position, i.e., constructed so as to be fully functional without the need for auxiliary apparatus to rotate it.

SUMMARY OF THE INVENTION

According to the present invention, the plate-formed attachment member, which has attached thereto a diaphragm and a press pad, is supported at opposite ends by transport units which allow for the transport of the plate-formed attachment member and supported structure outside of the press stand for access to and replacement of the diaphragm and/or press pad, and which thus allows for the press stand to be constructed without auxiliary structure to rotate it. The transportation units include transportation cars (which are movable along suitable tracks), and include connection units designed to be coupled by suitable structure to the plate-formed attachment member, which is itself suitably shaped for movement into and out of a press stand.

More specifically, the connection units are attached to the longitudinal ends of the plate-formed attachment member and include bearing means projecting in the longitudinal direction of the attachment member, and these projecting bearing means are rotatably journalled in bearing housings supported by the transportation cars.

Due to the utilization and placement of the transportation units, the elongated plate-formed attachment member can be moved into and out of a press stand along its longitudinal direction, and after it has been moved out of the press stand, it is rotatable such that the diaphragm and press pad (which structures are positioned beneath the plate-formed attachment member when in operational position within the press stand) can be repositioned to be facing upwardly such that easy access thereto is achieved.

The transportation cars may advantageously be constructed in the form of bogies, partly because of the great weight of the plate-formed attachment member, diaphragm and forming pad, and partly because of the enhanced stability provided thereby. In addition, the transportation units are advantageously provided with lifting devices which are functional to raise thd lower the noted bearings, the lowering junction being needed to provide a suitable clearance between the plate-formed attachment member and the upper yoke of the press stand when the plate-formed attachment member is to be removed from within the press stand, and the raising function being needed to provide sufficient clearance for the plate-formed attachment member (and auxiliary structures) to be rotated without obstruction when positioned outside the press stand.

Furthermore, at least one of the transportation units may include a drive device which is connected to the connection unit thereof in order to rotate the plate-formed attachment member about its bearing means when positioned outside of the press stand.

Further objects, advantages and features of the invention will be apparent in the arrangement and construction of the constituent parts in detail as set forth in the following description taken together with the accompanying drawings.

DESCRIPTION OF THE PREFERRED EMBODIMENT

Figures 1, 2:
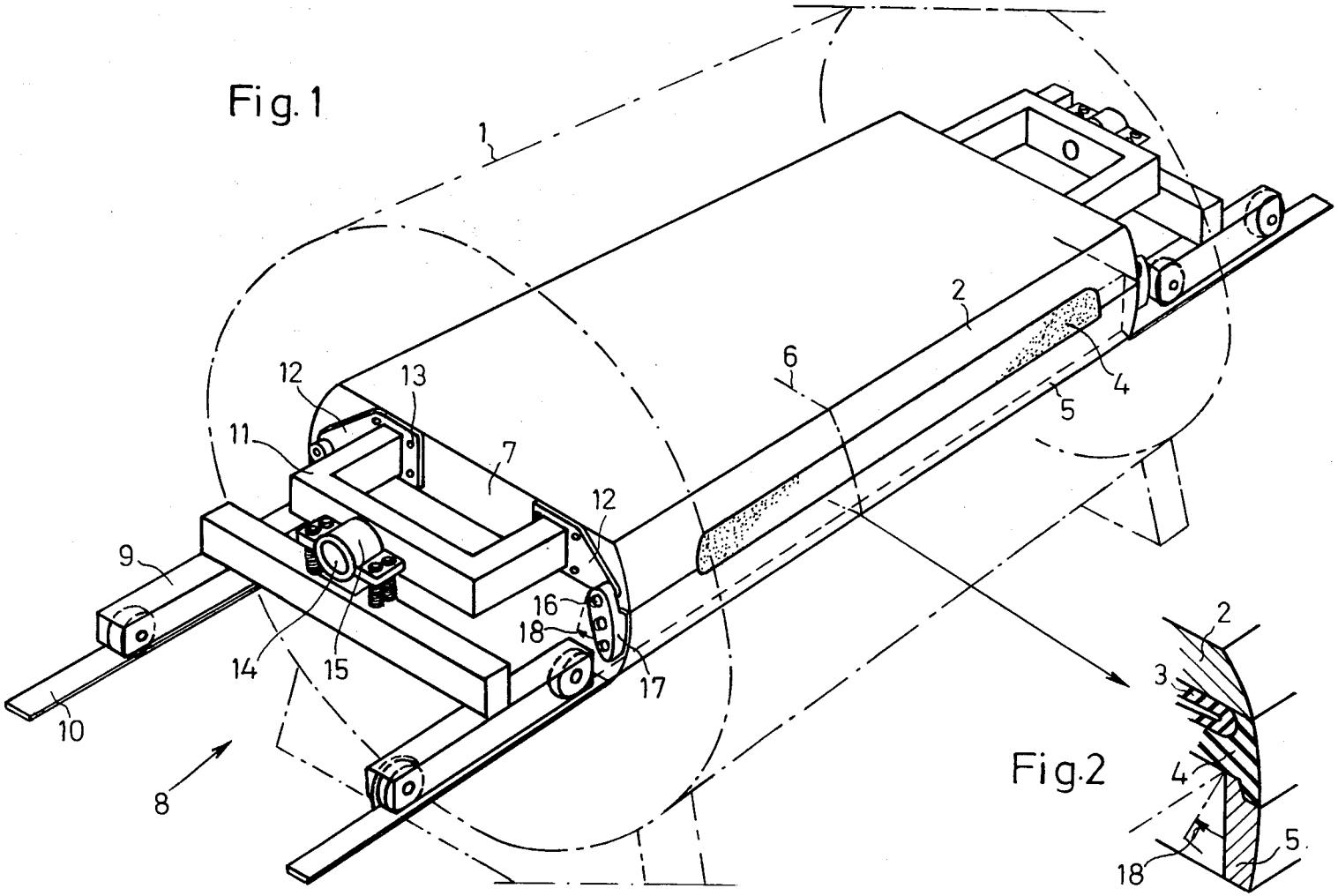
FIG. 1 depicts in schematic form a plate-formed attached member which is supported by two transportation units according to the present invention and which is positioned within a press stand.
FIG. 2 shows a sectional view through a side portion indicated at 6 in FIG. 1 of the plate-formed attachment member of FIG. 1.

In the FIGS., wherein like numerals refer to like structures, a press stand is indicated by 1, and a plate-formed attachment member is indicated by 2. Attached to the plate-formed attachment member is a flexible bag-like diaphragm 3 and a press pad 4, together with a side piece 5 which serves as a support member for the press pad 4. As can be seen from FIG. 1 the plate-formed attachment member has end portions 7 (only one of which is labeled) to which are attached the transportation units 8 according to the present invention.

The transportation units which support the opposite ends of the plate-formed attachment member 2 include connection units 11 (each comprised of a bottom section and two sections extending generally perpendicularly away therefrom to form a generally U-shaped member) which are connected to the attachment member by way of mounting plates 12 and bolts 13, and which are supported on transportation cars in the form of bogies 9. The bogies 9 run along elongated, parallel tracks 10 which extend through the bottom portion of the chamber within the press stand. Each connection unit 11 includes a bearing peg 14 (connected to the bottom section thereof at about the midway point) which is journalled in a bearing housing 15 attached to bogie 9, thus forming a bearing. This latter connection allows for the plate-formed attachment member to be rotated around an axis formed between the transportation units at opposite ends of the plate-formed attachment member when located outside of the press stand 1, i.e., about an axis formed between the bearing housings 15.

Rotatably journalled to mounting plates 12 by way of pegs 16 and arms 17 which are connected to the longitudinal ends of the side pieces 5 and thus not only provide support for the side pieces, but allow for them to be turned inwardly, as indicated by arrow 18 in FIG. 2, so that a clearance is obtained between the side strips 5 and the press stand when the plate-formed attachment member is moved into or out of the press stand.

Figure 3:
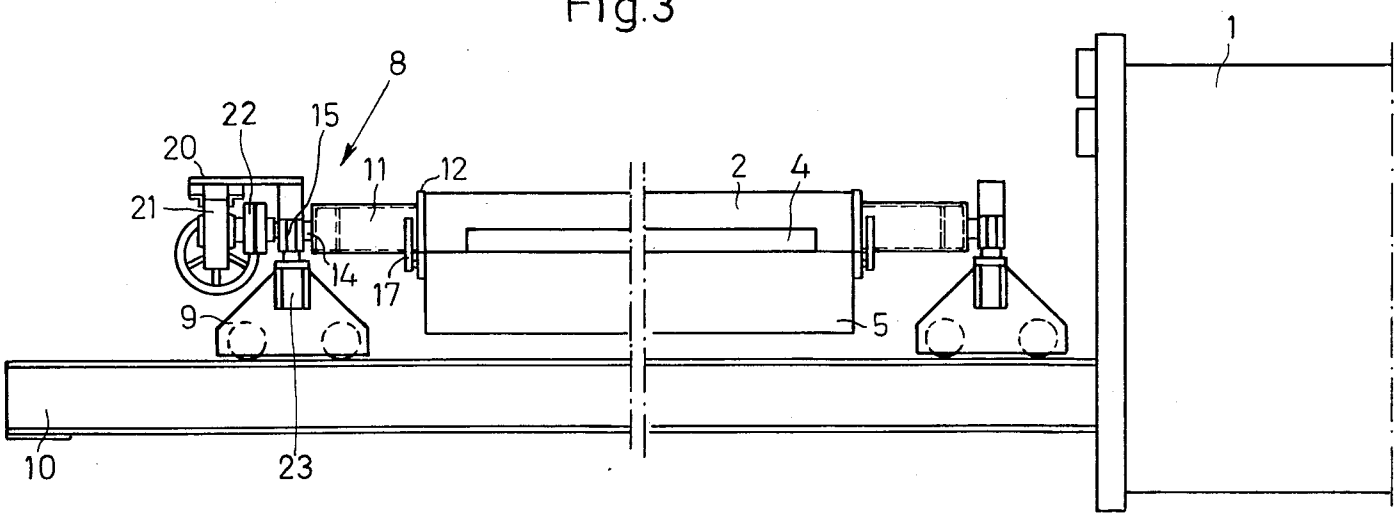
FIG. 3 shows a side view of the inventive structure when the plate-formed attachment member and attendant structure is positioned outside the press stand, and shows the connecting and adjusting structure of the transportation units.

As can be seen from FIG. 3, at least one of transportation units includes a bracket 20 mounted on the bogie 9, the bracket supporting a worm gear 21 which has an output shaft connected to pin 14 via coupling 22. The worm gear 21 may be hand-or motor-driven, and the turning thereof functions to rotate plate-formed attachment member 2 and the structure attached thereto, i.e., diaphragm 3, press pad 4, side pieces 5, such that they are disposed vertically above the attachment member 2 for each access. In addition, at least one of the bogies 9 is provided with lifting cylinders 23 which operate to raise or lower bearing housings 14, and thus to raise or lower connection unit 11 and the plate-formed attachment member 22 (and the structure attached thereto) to either a high enough position to allow for rotation of attachment member 2 when outside press stand 1, or a low enough position to allow for operation of the press when inside press stand 1.

While there has been shown and described what is considered to be a preferred embodiment of the present invention, it will be obvious to those skilled in the art that various changes and modifications may be made therein without departing from the invention as defined in the appended claims.

We claim:

1. A hydraulic press for pressing sheets of metal against a tool in order to be formed thereby, the press comprising:

an elongated press stand which is fixedly mounted, the press stand including a pressure space therein which is capable of containing a tool, an elongated plate-formed attachment member which supports a flexible bag-like diaphragm and a press pad which is capable of contacting a sheet of metal and forming it around a tool in the pressure cell, two transportation units connected to said plate-formed attachment member for moving said plate-formed attachment member with supported diaphragm and press pad into and out of said pressure space within said press stand, track means for supporting said two transportation units and for conveying said two transportation units into and out of said pressure space within said press stand, said two transportation units each including a transportation car and a connection, each said connection unit being connected to said plate-formed attachment member and each transportation unit including a bearing such that the plate-formed attachment member is rotatable about an axis formed between said transportation units, and at least one of said two transportation units includes means for raising and lowering the connection unit thereof and thus said plate-formed attachment member at the connection point with said connection unit.

2. The hydraulic press of claim 1, wherein each of said transportation cars comprises a bogie.

3. The hydraulic press of claim 1, wherein said elongated plate-formed attachment member has end portions at ech of the elongated ends thereof, wherein each of the connections units of said two transportation units is attached to a respective end portion of said plate-formed attachment member, and wherein each of said transportation units includes a bearing housing and a bearing pin connected to a respective connection unit, said plate-formed attachment member being rotatable about an axis formed between said bearing housings.

4. The hydraulic press of claim 3, wherein each of the two connection units comprises a generally U-shaped member having a bottom section and two sections extending generally perpendicularly away therefrom, said two perpendicular sections being connected to a respective end portion of said plate-formed attachment member, and said bearing pin being connected to said bottom section at about the midway point thereof.

5. The hydraulic press of claim 3, wherein each of said two transportation units includes means for raising and lowering the connection unit thereof so as to raise and lower said plate-formed attachment member at each of the end portions thereof.

6. The hydraulic press of claim 1, wherein at least one of said transportation units includes a means for rotating the connection unit thereof such that said plate-formed attachment member is rotated about said axis between said transportation. units.

7. The hydraulic press of claim 1, wherein said track means includes two separate, elongated parallel tracks which extend through said elongated press stand, and wherein each of said transportation units includes a bogie which is supported by and runs over said two separate, elongated parallel tracks.

* * * * *